US005216849A

United States Patent [19]

Clack et al.

[11] Patent Number: 5,216,849

[45] Date of Patent: Jun. 8, 1993

[54] APPARATUS AND METHOD FOR SANDBLASTING PIPE

[75] Inventors: Russell H. Clack; Stanley Davis; Ricki L. Berry, all of Artesia, N. Mex.

[73] Assignee: Navajo Refining Company, Artesia, N Mex.

[21] Appl. No.: 706,759

[22] Filed: May 29, 1991

[51] Int. Cl.[5] ..... B24C 3/08

[52] U.S. Cl. ..... 51/417; 51/424; 51/429; 51/439; 51/319; 15/104.04

[58] Field of Search ..... 51/410, 417, 424–426, 51/428, 429–438, 439, 431, 432, 317, 318, 319–320; 15/104.04

[56] References Cited

U.S. PATENT DOCUMENTS

| | | | |
|---|---|---|---|
| 2,037,047 | 4/1936 | Rosenberger | 51/417 |
| 2,460,989 | 2/1949 | Kraner | 51/426 |
| 2,869,291 | 1/1959 | Clay | 51/411 |
| 3,127,706 | 4/1964 | Giffen | 51/431 |
| 3,228,146 | 1/1966 | Rosengarten et al. | 51/411 |
| 3,362,109 | 11/1968 | Wallace | 51/424 |
| 3,882,639 | 5/1975 | Kollbach | 51/415 |
| 4,011,690 | 3/1977 | Braithwaite et al. | 51/410 |
| 4,205,694 | 6/1980 | Thompson et al. | 118/DIG. 11 |
| 4,466,469 | 8/1984 | Brouwer et al. | 139/435.2 |
| 4,552,594 | 11/1985 | van Voskuilen et al. | 134/180 |
| 4,603,516 | 8/1986 | Hoffman | 51/425 |
| 4,677,998 | 7/1987 | van Voskuilen et al. | 134/172 |
| 4,953,496 | 9/1990 | Taylor et al. | 51/429 |
| 5,056,271 | 10/1991 | Rose | 51/429 |

*Primary Examiner*—Bruce M. Kisliuk
*Assistant Examiner*—Eileen P. Morgan
*Attorney, Agent, or Firm*—Keck, Mahin & Cate

[57] ABSTRACT

Apparatus and method for field sandblasting the exterior surface of pipe to be wrapped or coated and installed underground. Abrasive granular material is forced by compressed air through a plurality of hoses to a plurality of respective nozzles. The nozzles direct the granular material into a plurality of blast tubes radially extending from a sandblast chamber through which is inserted the pipe to be cleaned. As the pipe is passed through the sandblast chamber, its surface is uniformly impinged, cleaned and etched by the granular material propelled through the blast tubes. After impinging the pipe, the granular material exits the sandblast chamber by gravity through a discharge chute.

22 Claims, 4 Drawing Sheets

APPARATUS AND METHOD FOR SANDBLASTING PIPE

TECHNICAL FIELD OF THE INVENTION

This invention generally relates to exterior pipe cleaning and, more particularly, is concerned with an apparatus and method for quickly and economically sandblasting the exterior surface of a pipe in preparation for applying a protective coating or tape.

BACKGROUND OF THE INVENTION

Many types of commodities are today transported by underground pipeline. For example, water, crude oil, natural gas, ammonia, and numerous other substances are transported by buried pipeline. In order to prevent corrosion of buried metal pipe, and to extend its useful life, pipe to be buried is often coated with a protective primer or coating, or wrapped with protective tape, in the field just prior to laying it in the trench and backfilling over it.

Installers of underground pipeline often have difficulty, however, with poor adhesion of coating, primer, or tape applied in the field, due to inadequate pipe surface preparation. For proper adhesion of coating or tape, the exterior surface of the pipe must be completely clean of any foreign substances, and preferably roughened by abrasion or by surface etching. Even newly manufactured and delivered pipe, however, is seldom in this condition at the time it is to be laid. New metal pipe typically is delivered with a coating of mill scale which inhibits good adhesion. New steel pipe also forms a surface layer of rust during transit and storage in the field. Environmental effects and exposure during transit and storage may leave dirt, oil, grease, asphalt, tar or a variety of other deposits on the pipe surface. Used pipe to be relaid may have previously applied coating, primer or tape that will require removal before reinstallation. Therefore, there is a need for an apparatus and method for removing previous coatings, deposits, rust, and mill scale from pipe in the field so that newly applied tape, coating or primer will properly adhere.

In recent years, several devices and methods have been used for field cleaning of pipe. One such device is a pipeline traveling knife/brush machine, as manufactured by Eagle Manufacturing Company, model no. R.C.P.T. 6"-12", or by Remco Manufacturing Company, model no. SM-DR-2"-8". These machines have a hollow cylindrical body open on both ends to receive a pipe to be cleaned. The cylindrical body houses rotary knives or scrapers that encircle the pipe and scrape the exterior surface, and rotary wire brushes that vigorously brush the pipe surface. Another such pipeline traveling device is manufactured by Cups Company. The Cups device uses high pressure water spraying in an attempt to clean the exterior surface of the pipe.

While these prior devices may be somewhat effective as a means of cleaning and preparing a pipe surface, they suffer from several inherent disadvantages. First, at best, these devices remove only approximately 70 percent of asphalt, tar, and certain types of prior coatings applied to the pipe. Second, these prior devices are relatively ineffective at removing mill scale or rust from steel pipe. The failure of these cleaning devices to completely remove these substances or deposits results in significantly reduced adhesion of field-applied tape and protective coatings, and ultimately, in reduced protection of buried pipe. Third, even when these cleaning machines are successful at removing all deposits from a pipe surface, the machines accomplish little or no surface etching of a smooth pipe surface, which is necessary to achieve lasting adhesion of tape or coating. The wire brushes in knife/brush machines tend to burnish the pipe surface, rather than roughening it. Fourth, prior cleaning methods are slow. For example, the Cups device can clean only about 2,500 feet of pipe per 8 hour day. Fifth, field cleaning by these prior devices is expensive. For instance, field cleaning a pipe with the Cups machine costs approximately $2 per lineal foot of pipe.

Consequently, a need exists for a low-cost, high-speed apparatus and method for effectively and reliably field cleaning a pipe of mill scale, rust, prior coatings, environmental deposits, and also for abrading and etching the pipe surface to maximize adhesion of field-applied tape or coating.

SUMMARY OF THE INVENTION

The present invention provides an apparatus for sandblasting the exterior surface of a pipe, comprising means for producing a plurality of fast-moving streams of abrasive granular material, means for simultaneously impinging said streams of abrasive granular material against a substantially cylindrical zone of the exterior circumference of the pipe, and means for advancing the zone of impingement of abrasive granular material along an axial direction of the pipe. The means for producing the fast-moving streams of abrasive granular material includes a reservoir containing abrasive granular material, a plurality of supply conduits each having a first end opening into the reservoir and a second end opening into an air conduit for conveying a fast-moving air stream, and means for pressurizing the reservoir sufficient to propel the abrasive granular material from the reservoir into the supply conduits. The means for simultaneously impinging the streams of abrasive granular material against the cylindrical zone of the pipe circumference includes, for each stream of granular material, a conduit for conveying the stream to a nozzle, each nozzle affixed in a plane perpendicular to the pipe axis, and directed so as to project the abrasive granular material toward the pipe. The pipe sandblasting apparatus further includes a blast chamber having an axial bore sized for receiving a pipe to be sandblasted, a plurality of blast tubes radially extending from the longitudinal axis of the blast chamber and opening into the chamber, each blast tube having a nozzle directed into its opposite end, and a discharge chute extending from the blast chamber by which the abrasive granular material may exit the chamber after impinging against the pipe.

This invention also provides a method for sandblasting the exterior surface of a pipe, comprising the steps of producing a plurality of fast-moving streams of abrasive granular material, impinging the abrasive granular material against a substantially cylindrical zone of the exterior surface of a pipe, including the entire circumference of the pipe, and advancing the zone of impingement of the abrasive granular material along an axial direction of the pipe. The plurality of fast-moving streams of abrasive granular material is produced by partially filling a closed container with the granular material, producing a fast-moving stream of air in each of a plurality of conduits, conveying the granular material from its container in a respective plurality of conduits, and injecting the granular material from each conduit into one of the fast-moving air streams. Each stream of abrasive granular material is then accelerated and diverged through a nozzle, and is propelled against the exterior surface of the pipe, each stream in a different converging radial direction toward the axis of the pipe.

BRIEF DESCRIPTION OF THE DRAWINGS

For a more complete understanding of the present invention, and the advantages thereof, reference is now made to the following description of the preferred embodiment, taken in conjunction with the accompanying drawings, in which.

DETAILED DESCRIPTION OF THE INVENTION

Figure 1:
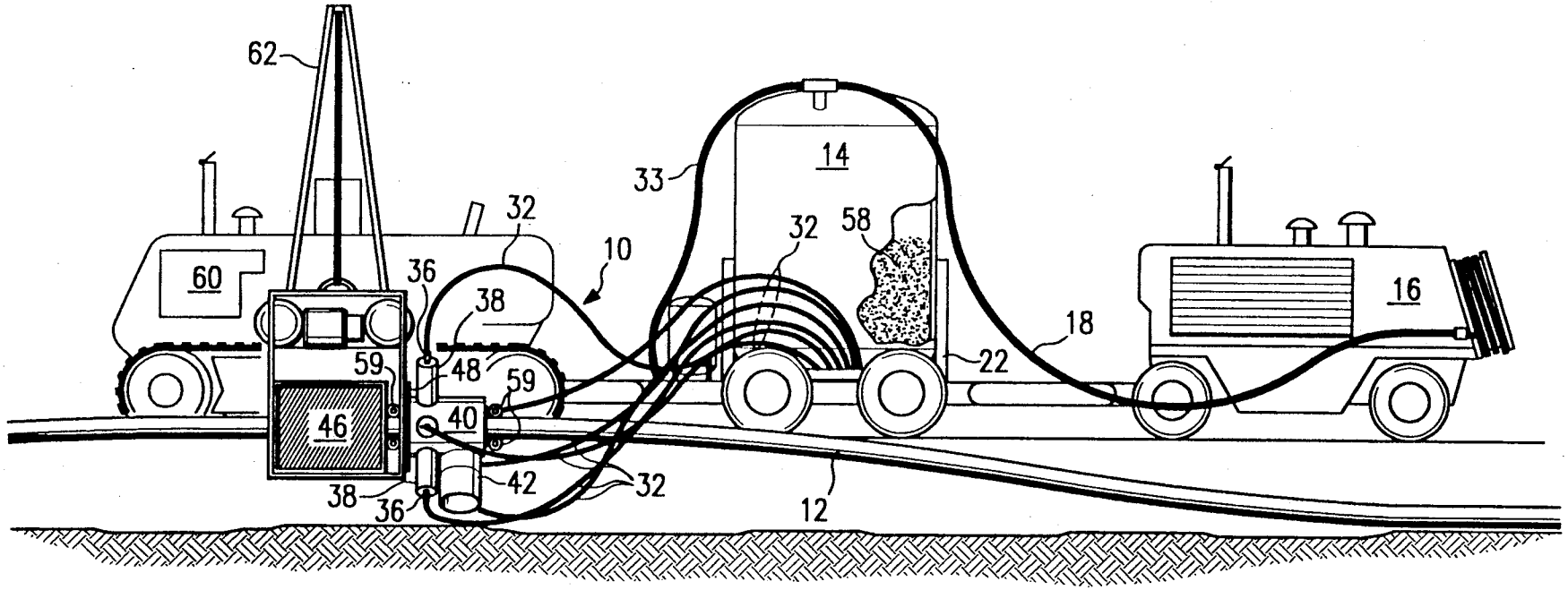
FIG. 1 is a side elevational view of one embodiment of a pipe sandblasting apparatus conforming with this invention, together with a conventional line traveling pipe cleaning machine, as it might be used for field cleaning a pipe.

The preferred embodiment of the present invention and its advantages are best understood by referring to the drawings, like numerals being used for like and corresponding parts of the various drawings.

Figure 2:
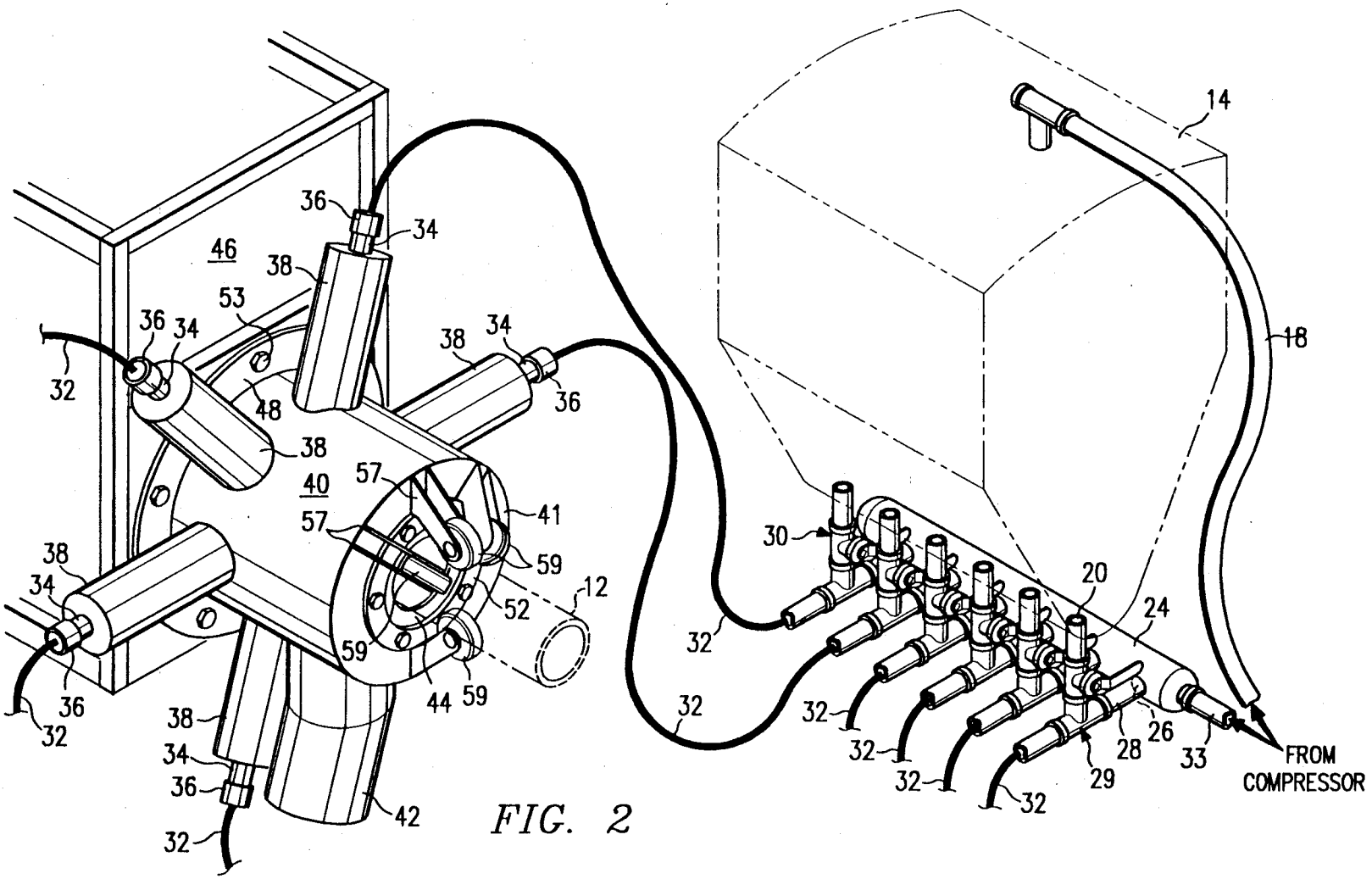
FIG. 2 is a perspective view of the blast chamber, blast tubes, nozzles, and discharge chute of this invention, shown attached to a pipe cleaning machine of the prior art, and a schematic diagram illustrating the means for producing the plurality of streams of granular material.

In FIG. 1 there is shown a pipe sandblasting apparatus and associated equipment, generally designated 10, as it might be used to sandblast a pipe 12 in the field prior to tape wrapping or coating pipe 12. A sand pot or tank 14 is pressurized by compressed air from an air compressor 16 through a rubber hose or other suitable conduit 18. The sand tank 14 may be supported on and transported by a suitable wheeled vehicle 22. Referring to FIG. 2, the sand tank 14 empties at or near its bottom into a plurality of outlet pipes or hoses 20, each of which hose 20 leads to a ball valve 30. The outlet side of each ball valve 30 leads to a tee pipe fitting 29. Compressed air is also delivered from air compressor 16 through a hose 33 to an air manifold 24. Manifold 24 empties through a plurality of orifices 26 into hoses or conduits 28 leading to a second inlet of tee pipe fittings 29. A rubber hose 32 leads from the outlet side of each tee fitting 29 to a ceramic nozzle 34. Although six hoses 32 and nozzles 34 are illustrated, the preferred number of hoses 32 and nozzles 34 for this invention will vary with the exterior diameter of pipe 12 to be sandblasted. The hoses 32 are preferably all of equal length.

Figure 7:
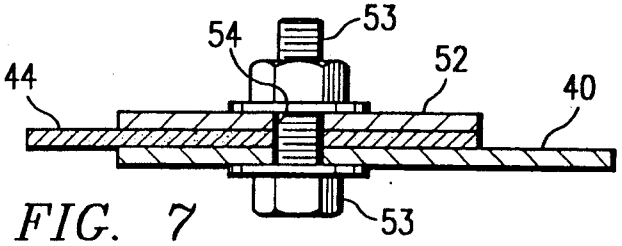
FIG. 7 is a fragmentary cross-sectional view taken along line 7—7 in FIG. 3, showing how a gasket and gasket retaining ring are attached to the blast chamber body.
Figure 6:
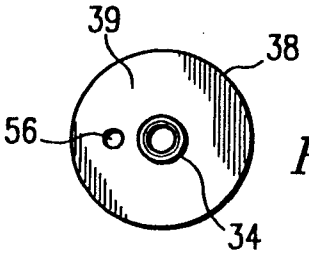
FIG. 6 is an enlarged view of a blast tube viewed from the nozzle end, showing the nozzle and vent hole therein.
Figure 3:
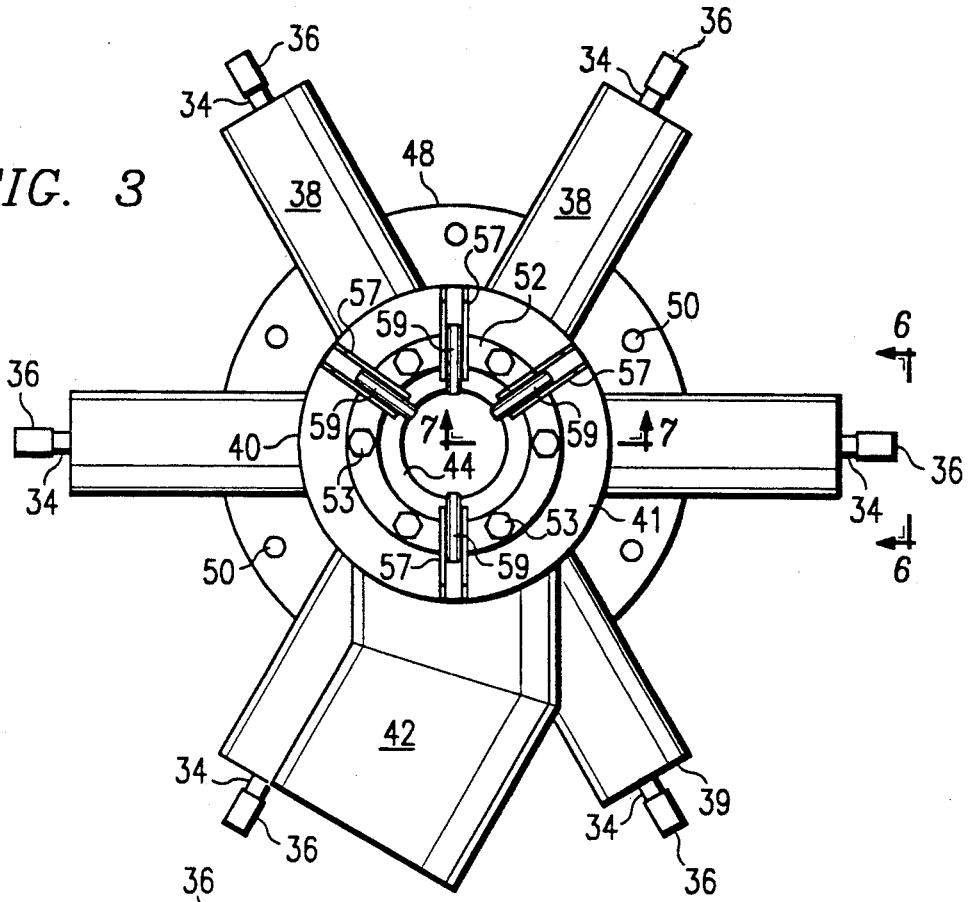
FIG. 3 is a plan view of the blast chamber of this invention, together with the blast tubes, nozzles, discharge chute, gasket ring, and gasket.

Referring now to FIG. 3, hoses 32 are connected to the nozzles 34 by couplings 36. The nozzles 34 are threaded into cylindrical blast tubes 38 extending radially from a sandblast chamber, body or housing 40. The sandblast chamber 40 is cylindrical in shape and open on both ends to receive the pipe 12 to be cleaned. A cylindrical discharge chute 42 opens into and extends radially from the lower portion of the sandblast chamber 40. Affixed to inlet and outlet ends 41 and 43, respectively, of sandblast chamber 40 is a flexible, ring-shaped gasket 44 which partially closes the gap between the sandblast chamber 40 and pipe 12. The gaskets 44 are affixed to sandblast chamber 40 by gasket retaining rings 52. The retaining rings 52 are attached to the ends 41 and 43 of sandblast chamber 40 by mechanical fasteners 53 inserted through a plurality of holes 54 in retaining rings 52 and in the ends 41 and 43 of sandblast chamber 40, as best illustrated in FIG. 7. Each blast tube 38 has formed in its closed end 39, and adjacent to its respective nozzle 34, a vent hole 56, as illustrated in FIG. 6.

Figure 4:
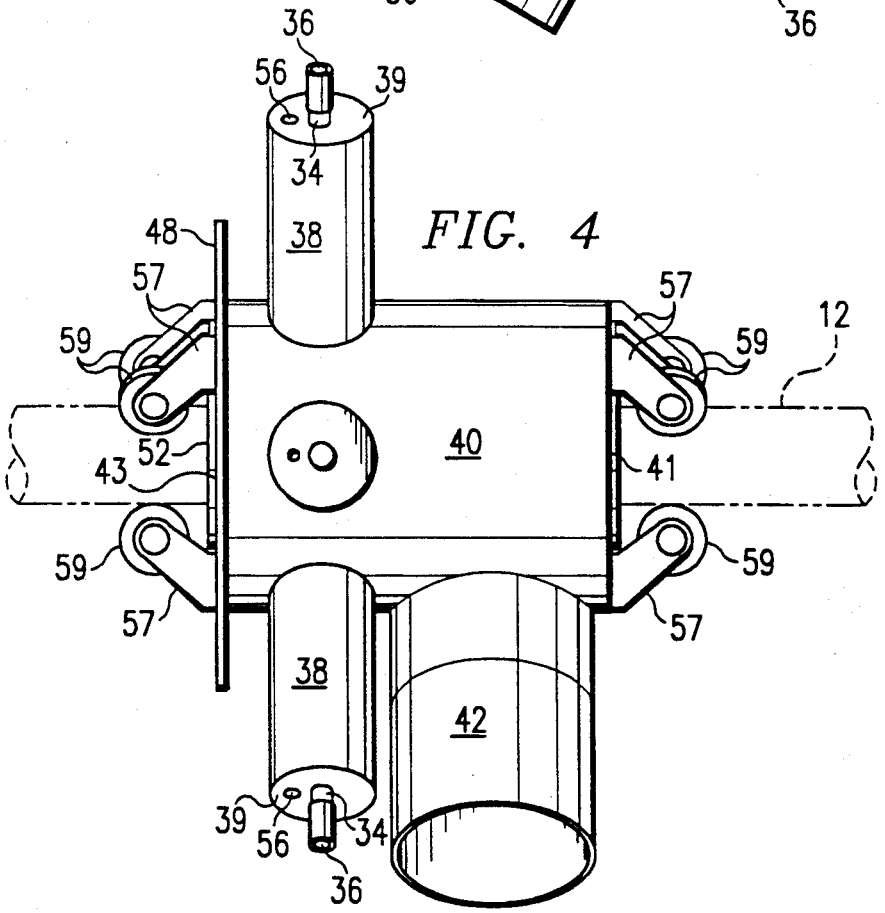
FIG. 4 is a side elevational view of the blast chamber of FIG. 3.

Referring again to FIGS. 3 and 4, also affixed to inlet and outlet ends 41 and 43 of sandblast chamber 40 are a plurality of brackets 57 to which are rotatably mounted wheels 59. Wheels 59 support blast chamber 40 from pipe 12, permit blast chamber 40 to roll along pipe 12 as it is being sandblasted, and keep pipe 12 centered within blast chamber 40. Preferably, the wheels 59 are arranged radially around the longitudinal axis of sandblast chamber 40, with one wheel 59 at bottom dead center position, one wheel 59 at top dead center position, and a wheel 59 at a position 60° clockwise and 60° counterclockwise with respect to the top dead center positioned wheel 59, as illustrated in FIG. 3. Wheels 59 may optionally be driven by a motor (not illustrated) to enable sandblast chamber 40 to propel itself along pipe 12 by rotation of wheels 59.

Referring again to FIGS. 1 and 2, sandblast chamber 40 may optionally be attached at its inlet end to a conventional line traveling pipe cleaning machine 46. The inlet end 41 of the sandblast chamber 40 is provided with a circular flange 48 having a plurality of holes 50 for attachment to the pipe cleaning machine 46 by mechanical fasteners 53. The pipe cleaning machine 46 may be a knife/brush machine, as manufactured by Eagle Manufacturing Company or Remco Manufacturing Company, a water spraying machine, as manufactured by Cups Company, or any similar line traveling pipe cleaning machine. Machine 46 may have motor-driven wheels, similar to wheels 59 described above, for propelling itself and sandblast chamber 40 along pipe 12.

Figure 5:
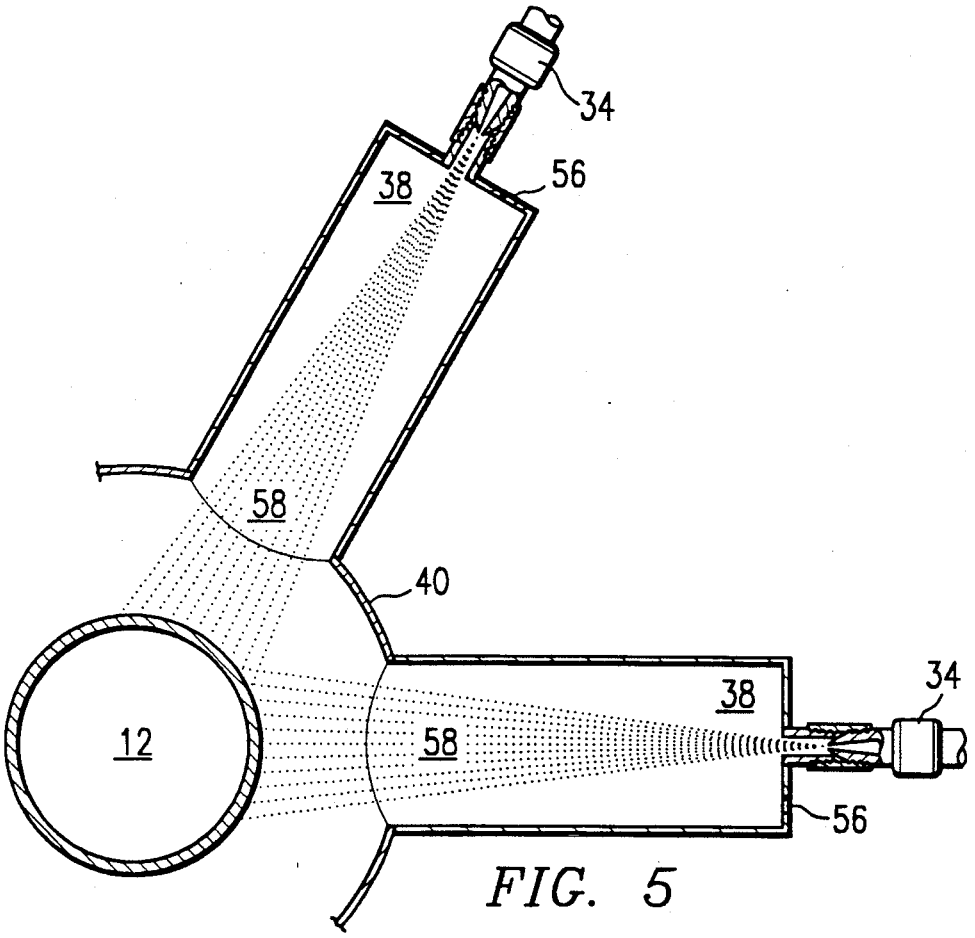
FIG. 5 is an enlarged cross-sectional view of a fragmentary portion of the blast chamber, blast tubes, and nozzles of FIG. 3, showing a pipe being sandblasted from two adjacent nozzles.

To sandblast a pipe 12, the sand tank 14 is first partially filled with an abrasive granular material 58. Copper reverb slag, manufactured by Parker Brothers & Company, Inc., El Paso, Tex., is the preferable abrasive granular material 58 for use with this invention, although silicon dioxide ($SiO_2$), iron tailings, powdered quartz, emery or coarse sand particles may also be used. Referring again to the schematic diagram in FIG. 2, the sand tank 14 and manifold 24 are then pressurized by the air compressor 16. The granular material 58 is delivered by air pressure and gravity through sand tank outlet pipes 20 and valves 30 to tee fittings 29. The compressed air delivered by air compressor 16 to manifold 24 is diverted through manifold orifices 26 into a plurality of streams or jets which flow through tee fittings 29. Granular material 58 is picked up by the air streams flowing through tee fittings 29, and carried into hoses 32. Hoses 32 carry the streams of granular material 58 to the respective nozzles 34. Nozzles 34 accelerate, diverge and propel the streams of granular material 58 into blast tubes 38. Blast tubes 38 direct and convey the jets of granular material 58 against the exterior surface of pipe 12. The surface of pipe 12 is thus cleaned, abraded and etched by the high velocity impingement of granular material 58, as best illustrated in FIG. 5. After impinging pipe 12 in sandblast chamber 40, the granular material 58 drops down and exits the chamber 40 by gravity through discharge chute 42. The discharged granular material 58 may optionally be collected into a nurse hopper, cart, or bag (not illustrated) for reuse, if desired.

By use of a sufficient number of nozzles 34 and blast tubes 38, the entire surface of pipe 12 in a zone perpendicular to its axis may be sandblasted simultaneously. Preferably, the surface area of pipe 12 sandblasted by each nozzle 34 will overlap somewhat, to insure complete surface coverage. To sandblast a continuous length of pipe 12, pipe sandblasting apparatus 10 is slowly advanced along the axial direction of pipe 12 by tractor 60 and crane 62. Alternatively, sandblast chamber 40 may be self-propelled along pipe 12 by motor-driven wheels 59, if so equipped, or sandblast chamber 40 may be carried along pipe 12 by conventional pipe cleaning machine 46, as illustrated in FIG. 1. In still another alternative method, sandblast chamber 40 may be held stationary, and pipe 12 advanced through it. Ball valves 30 are provided for the purpose of equalizing flow rates of granular material 58 through each nozzle 34.

The optimum sizes and quantities of component parts of the pipe sandblasting apparatus 10 of this invention will vary with the size of pipe 12 to be sandblasted. For example, the number of nozzles 34 and blast tubes 38 needed will vary in direct proportion to the outer diameter of pipe 12. An 8 inch outer diameter pipe can be uniformly sandblasted by a pipe sandblasting apparatus 10 having six nozzles 34 and blast tubes 38 as illustrated in FIG. 3.

The following dimensional and capacity specifications are applicable to a pipe sandblast apparatus designed to sandblast an 8 inch outer diameter pipe. Each hose 32 is 25 feet long and of 2 inch inner diameter. The sandblast chamber 40 has a 24 inch outer diameter, 30 inch length, $\frac{1}{4}$ inch wall thickness, and may be fabricated from a length of standard, commercially available steel pipe. Blast tubes 38 are 18 inches long and have an outer diameter of $8\frac{5}{8}$ inches. Discharge chute 42 has an outer diameter of 16 inches, and is approximately 18" long. Ring-shaped gaskets 44 have an inner diameter opening of $8\frac{1}{2}$ inches. Vent holes 56 in blast tubes 38 are $1\frac{1}{2}$ inches in diameter. Nozzles 34 are preferably composed of a ceramic material, and have an inner diameter of $\frac{5}{8}$ inch to 1 inch. The Boride no. 7 nozzle, commercially available through air supply or sandblasting vendors, is preferred. Manifold 24 may be fabricated from a length of 4 inch steel pipe, and is supplied with compressed air through a pipe or hose 33 of 3 inch inner diameter. Couplings 36 are $1\frac{1}{2}$ inch, 3,000 lb. screw couplings, such as Victralic couplings. Air compressor 16 should have a capacity of at least 850 cubic feet per minute, and should maintain a nozzle pressure of 70 to 100 pounds per square inch. Sand tank 14 is a commercially available air pot, preferably of 5 ton capacity.

The pipe sandblasting apparatus 10 of this invention effectively removes not only dirt, grease, oil, asphalt, tar, previous coatings, and other deposits from a pipe surface, but also effectively removes mill scale and rust from steel pipe, and cleans pipe to a white metal or a near white metal finish. In addition to cleaning the pipe surface of essentially all foreign material, the apparatus 10 also abrades and etches the pipe surface for improved adhesion of field-wrapped tape or field-applied primer or coating. Using the pipe sandblasting apparatus 10 of this invention, a crew can clean approximately 10,000 feet of pipe per eight hour day, compared to a maximum of about 2,500 feet per day by previous pipe cleaning methods. Furthermore, pipe can be cleaned by the apparatus 10 of this invention for approximately 25 cents per foot, compared to a cost of about two dollars per foot for cleaning by radial water blasting.

The pipe sandblasting apparatus and method of the present invention, and many of its intended advantages, will be understood from the foregoing description, and it will be apparent that, although the invention and its advantages have been described in detail, various changes, substitutions, and alterations may be made in the manner, procedure, and details thereof without departing from the spirit and scope of the invention, as defined by the appended claims, or sacrificing all of its material advantages, the form hereinbefore described being merely a preferred or exemplary embodiment thereof.

What is claimed is:

1. Apparatus for sandblasting an exterior surface of a pipe having a longitudinal axis, comprising:

means for producing a plurality of fast-moving streams of abrasive granular material;

means for simultaneously impinging said streams of abrasive granular material against a substantially cylindrical zone of the exterior surface of said pipe, including the entire circumference thereof, said means for simultaneously impinging including, for each stream of granular material, a conduit for conveying said stream to a nozzle, each nozzle affixed in a plane perpendicular to said pipe axis, and directed so as to project said abrasive granular material toward said pipe, a blast chamber having an upper and a lower surface, an axial bore of said chamber having an inlet end and an outlet end sized for receiving a pipe to be sandblasted, and a plurality of blast tubes radially extending from said axial bore of said blast chamber and opening onto said chamber, each said blast tube having an end opposite said axial bore opening for receiving a respective one of said nozzles;

a plurality of rotatable wheels arranged radially about the axis of said pipe and coupled to a motor to impart rotational force thereto, said wheels having their outer cylindrical surfaces in rolling contact with said pipe, and together operable to move said blast chamber along said axis of said pipe when said wheels are rotated by said motor; and said blast chamber having formed on its inlet end a flange, said plurality of rotatable wheels being incorporated into a motorized rotary brush and knife pipe cleaner mounted to said flange on said blast chamber.

2. The pipe sandblasting apparatus of claim 1, wherein said blast chamber, blast tubes, and nozzles are advanced along said axis of said pipe by said rotatable wheels in said brush and knife pipe cleaner.

3. Apparatus for sandblasting a pipe having a longitudinal axis, comprising:

a body having an upper and a lower surface, an axial bore of said body having an inlet end and an outlet end, a diameter of said axial bore sized to receive a pipe to be sandblasted;

a plurality of elongated blast tubes radially extending from said axis and opening onto said bore, each said blast tube having an opening remote from said bore;

for each blast tube, a nozzle affixed to a respective one of said openings;

for each nozzle, a nozzle conduit having a first end affixed thereto for delivery of abrasive granular material;

a single abrasive granular material reservoir for containing said abrasive granular material, said reservoir having a plurality of exit orifices for dispersing abrasive granular material;

a manifold having an inlet orifice for receiving compressed gas and a plurality of exit orifices, equal in number to said blast tubes, for distributing said gas into a plurality of air jets;

for each said air jet, means for injecting into said air jet said abrasive granular material dispersed from said exit orifices in said granular material reservoir, second ends of said nozzle conduits affixed to said means for injecting;

means for pressurizing said manifold sufficient to produce said plurality of air jets, and to propel said abrasive granular material through said nozzle conduits and nozzles and against said pipe to be sandblasted; and means for advancing said sandblasting apparatus body, blast tubes, and nozzles along said axis of said pipe.

4. The apparatus of claim 3, wherein said means for injecting into said air jets said abrasive granular material consists of:

for each said air jet, a tee pipe fitting having a first and a second inlet port and an outlet port, second ends of said nozzle conduits affixed to said outlet ports;

a plurality of air conduits for conveying said air jets from said exit orifices in said manifold to said first inlet ports on said tee fittings; and supply conduits for conveying said abrasive granular material from said exit orifices in said reservoir to said second inlet ports on said tee fittings.

5. The apparatus of claim 3, wherein said means for pressurizing said manifold consists of an air compressor having an air discharge outlet connected to said inlet orifice on said manifold.

6. The apparatus of claim 3, wherein said means for advancing said sandblasting apparatus body, blast tubes, and nozzles along an axial direction of said pipe includes:

a motorized, wheeled vehicle capable of moving in the axial direction of said pipe to be sandblasted; and a crane mounted on said vehicle for supporting said apparatus body, blast tubes, and nozzles.

7. The apparatus of claim 3, wherein each of said plurality of nozzle conduits for delivery of sandblasting material is of equal length.

8. The apparatus of claim 3, further including a discharge chute opening onto and extending from said lower surface of said body by which said sandblasting material may, after being propelled against said pipe, exit said body by gravity.

9. The apparatus of claim 4, further including, for each of said nozzles, a valve for adjusting the flow rate of abrasive granular material to said respective nozzle.

10. The apparatus of claim 9, wherein said valve for each said nozzle is located between said supply conduit and said tee fitting.

11. The apparatus of claim 9, wherein said valves are ball valves.

12. The apparatus of claim 3, wherein said body has affixed to its inlet end and to its outlet end a flexible gasket for providing an at least partial barrier to the egress of said abrasive granular material through said inlet and outlet ends, each said gasket disposed between an edge of an orifice of a respective one of said inlet and outlet ends and said pipe to be sandblasted.

13. The apparatus of claim 3, wherein said nozzles are composed of a ceramic material.

14. The apparatus of claim 3, wherein said abrasive granular material is copper reverb slag.

15. The apparatus of claim 3, further including a plurality of rotatable wheels arranged radially about the axis of said pipe and coupled to a motor to impart rotational force thereto, said wheels having their outer cylindrical surfaces in rolling contact with said pipe, and together operable to move said sandblast apparatus body along said pipe axis when said wheels are rotated by said motor.

16. The apparatus of claim 15, wherein said body has formed on its inlet end a flange, and wherein said plurality of rotatable wheels are incorporated into a motorized rotary brush and knife pipe cleaner mounted to said flange on said body.

17. The apparatus of claim 16, wherein said body, blast tubes, and nozzles are advanced along said axis of said pipe by said rotatable wheels in said brush and knife pipe cleaner.

18. The apparatus of claim 3, wherein each said blast tube has an orifice in said blast tube near said opening remote from said body for venting said blast tube.

19. The apparatus of claim 8, wherein said sandblasting apparatus body has an orifice on its lower surface and adjacent to said discharge chute for venting said sandblast apparatus body.

20. The apparatus of claim 8, further including means for collecting and containing said abrasive granular material discharged from said discharge chute for reuse.

21. The apparatus of claim 20, wherein said means for collecting and containing said discharged abrasive granular material includes:

a nurse cart located at the outlet end of said discharge chute.

22. The pipe sandblasting apparatus of claim 3, wherein the manifold comprises standard sized, commercially available pipe.

* * * * *